US011227573B2

(12) United States Patent
Huang et al.

(10) Patent No.: US 11,227,573 B2
(45) Date of Patent: Jan. 18, 2022

(54) ACOUSTIC PANEL WITH ACOUSTIC UNIT LAYER

(71) Applicant: Toyota Motor Engineering & Manufacturing North America, Inc., Plano, TX (US)

(72) Inventors: Tai-Yun Huang, Ann Arbor, MI (US); Takumi J. Jinmon, Ann Arbor, MI (US); Takayuki Sugiyama, Ann Arbor, MI (US)

(73) Assignee: Toyota Motor Engineering & Manufacturing North America, Inc., Plano, TX (US)

( * ) Notice: Subject to any disclaimer, the term of this patent is extended or adjusted under 35 U.S.C. 154(b) by 567 days.

(21) Appl. No.: 16/172,125

(22) Filed: Oct. 26, 2018

(65) Prior Publication Data

US 2020/0135161 A1 Apr. 30, 2020

(51) Int. Cl.
*G10K 11/168* (2006.01)

(52) U.S. Cl.
CPC ..... *G10K 11/168* (2013.01)

(58) Field of Classification Search
CPC ..... G10K 11/168; G10K 11/172
USPC ..... 181/286
See application file for complete search history.

(56) References Cited

U.S. PATENT DOCUMENTS 5,445,861 A 8/1995 Newton et al.
6,290,022 B1 9/2001 Wolf et al.
7,395,898 B2 * 7/2008 Yang ..... G10K 11/172 181/286
8,820,477 B1 9/2014 Herrera et al.
8,869,933 B1 * 10/2014 McKnight ..... G10K 11/172 181/286
10,704,255 B2 * 7/2020 Hakuta ..... G10K 11/172
2003/0006090 A1 1/2003 Reed
2006/0257621 A1 11/2006 Kuriyama
(Continued)

FOREIGN PATENT DOCUMENTS

WO 2016102691 A2 6/2016

OTHER PUBLICATIONS

Ma et al., "Acoustic metasurface with hybrid resonances," Nature Materials (2014).

(Continued)

*Primary Examiner* — Forrest M Phillips
(74) *Attorney, Agent, or Firm* — Christopher G. Darrow; Darrow Mustafa PC

(57) ABSTRACT

An acoustic panel includes a plurality of acoustic units. Each acoustic unit includes a subwavelength cell, an acoustic septum attached across the cell and an acoustic backing attached across the cell behind the acoustic septum. The acoustic units have uniform constructions with the exception of varying cross-sectional dimensions, and varying peak absorption frequencies based on the varying cross-sectional dimensions. In relation to the peak absorption frequency for each acoustic unit, the acoustic septum is a vibratory membrane and the acoustic backing is an anti-vibration back plate, and the acoustic unit is acoustic impedance matched, whereby the acoustic unit is configured to substantially non-propagatively absorb frontal acoustic excitation at the peak absorption frequency using the acoustic septum and the acoustic backing.

20 Claims, 8 Drawing Sheets

(56) References Cited

U.S. PATENT DOCUMENTS

| | | | | |
|---|---|---|---|---|
| 2011/0240402 | A1* | 10/2011 | Chou | F16F 15/04 181/207 |
| 2012/0240486 | A1 | 9/2012 | Borroni | |
| 2015/0122577 | A1 | 5/2015 | Zalewski et al. | |
| 2016/0017810 | A1 | 1/2016 | Lord et al. | |
| 2016/0027427 | A1 | 1/2016 | Yang et al. | |
| 2016/0078857 | A1 | 3/2016 | Sheng et al. | |
| 2017/0053635 | A1 | 2/2017 | Leon et al. | |
| 2017/0089238 | A1 | 3/2017 | Leyko et al. | |
| 2018/0051462 | A1* | 2/2018 | Hakuta | E04B 1/86 |
| 2020/0143784 | A1* | 5/2020 | Huang | G10K 11/168 |

OTHER PUBLICATIONS

Huang, "Vibration of Thin Plates under Acoustic Excitations: its Application in Acoustic Metamaterials," North Carolina State University (2017).

* cited by examiner

| UNIFORM MATERIAL PROPERTIES | | | |
|---|---|---|---|
| Acoustic Septum Layer:<br>Polydimethylsiloxane (PDMS)<br>E=4.51e^6*(1+0.01i) Pascal<br>rho=965 kg/m^3<br>ν=0.48 | | Acoustic Backing Layer:<br>Aluminum<br>E=70e^9*(1+0.01i) Pascal<br>rho=2700 kg/m^3<br>ν=0.3 | |
| **UNIFORM DIMENSIONS** | | | |
| Back Cellular Panel: H=5 mm<br>Base Cellular Panel: H=9.7 mm<br>Front Cellular Panel: H=5 mm<br>All Cells: W=19.95 mm | | Acoustic Backing Layer: T=0.4 mm<br>Acoustic Septum Layer: T=0.254 mm | |
| **VARYING LENGTH CELLS → VARYING PEAK ABSORPTION FREQUENCIES** | | | |
| A1: L=19.95 mm<br>f=655 Hz<br>@ RC=0.0004154 | A2: L=18.75 mm<br>f=772 Hz<br>@ RC=0.08614 | A3: L=17.7 mm<br>f=847 Hz<br>@ RC=0.09043 | A4: L=18.225 mm<br>f=940 Hz<br>@ RC=0.09042 |
| B1: L=18.82 mm<br>f=675 Hz<br>@ RC=0.003933 | B2: L=18.525 mm<br>f=787 Hz<br>@ RC=0.02309 | B3: L=19.95 mm<br>f=885 Hz<br>@ RC=0.01067 | B4: L=18.975 mm<br>f=963 Hz<br>@ RC=0.07406 |
| C1: L=17.625 mm<br>f=685 Hz<br>@ RC=0.02552 | C2: L=18.3 mm<br>f=803 Hz<br>@ RC=0.001215 | C3: L=19.575 mm<br>f=899 Hz<br>@ RC=0.01708 | C4: L=18.75 mm<br>f=979 Hz<br>@ RC=0.01965 |
| D1: L=16.65 mm<br>f=693 Hz<br>@ RC=0.06583 | D2: L=18 mm<br>f=824 Hz<br>@ RC=0.02329 | D3: L=18.9 mm<br>f=919 Hz<br>@ RC=0.04799 | D4: L=18.45 mm<br>f=1000 Hz<br>@ RC=0.05826 |

FIG. 3A

ACOUSTIC PANEL WITH ACOUSTIC UNIT LAYER

TECHNICAL FIELD

The embodiments disclosed herein relate to acoustic panels and, more particularly, to acoustic panels in which transversely-oriented acoustic elements are used to attenuate the movement of frontal acoustic excitation behind the acoustic panels.

BACKGROUND

Acoustics and, more particularly, acoustic panels that attenuate the movement of frontal acoustic excitation behind the acoustic panels, have long been a focus of engineering design. Some acoustic panels include a cellular acoustic unit layer that features acoustic units. In these acoustic panels, the acoustic units include acoustically septumized cells. Using the acoustic septa and other acoustic elements, if any, attached across the cells, the acoustic unit layer is configured to attenuate the movement of frontal acoustic excitation past the acoustic unit layer.

SUMMARY

Disclosed herein are embodiments of an acoustic panel with an absorption-oriented acoustic unit layer. In one aspect, an acoustic panel includes a plurality of acoustic units. Each acoustic unit includes a subwavelength cell, an acoustic septum attached across the cell and an acoustic backing attached across the cell behind the acoustic septum. The acoustic units have uniform constructions with the exception of varying cross-sectional dimensions, and varying peak absorption frequencies based on the varying cross-sectional dimensions. In relation to the peak absorption frequency for each acoustic unit, the acoustic septum is a vibratory membrane and the acoustic backing is an anti-vibration back plate, and the acoustic unit is acoustic impedance matched, whereby the acoustic unit is configured to substantially non-propagatively absorb frontal acoustic excitation at the peak absorption frequency using the acoustic septum and the acoustic backing.

In another aspect, an acoustic panel includes a plurality of acoustic units whose construction is based on a cellular panel that at least partially forms a plurality of subwavelength, uniform height and varying cross-sectional dimension cells, an acoustic septum layer layered ahead of the cellular panel, and an acoustic backing layer layered behind the cellular panel. The coincident locations of the acoustic septum layer with the cells form associated uniform height-wise position acoustic septa attached across the cells. The coincident locations of the acoustic backing layer with the cells form associated uniform height-wise position acoustic backings attached across the cells behind the acoustic septa. The acoustic units respectively include the cells, the acoustic septa and the acoustic backings. The acoustic units have varying peak absorption frequencies based on the varying cross-sectional dimension cells. In relation to the peak absorption frequency for each acoustic unit, the acoustic septum is a vibratory membrane and the acoustic backing is an anti-vibration back plate, and the acoustic unit is acoustic impedance matched, whereby the acoustic unit is configured to substantially non-propagatively absorb frontal acoustic excitation at the peak absorption frequency using the acoustic septum and the acoustic backing.

In yet another aspect, an acoustic panel includes a plurality of acoustic units whose construction is based on a plurality of subwavelength, rectangular cross-section, uniform height and varying cross-sectional dimension cells configured to rectify diffused frontal acoustic excitation into normal frontal acoustic excitation. The acoustic units respectively include the cells, uniform depth, uniform thickness and uniform material property acoustic septa attached across the cells, and uniform height-wise position, uniform thickness and uniform material property acoustic backings attached across the cells behind the acoustic septa. The acoustic units have varying peak absorption frequencies based on the varying cross-sectional dimension cells. In relation to the peak absorption frequency for each acoustic unit, the acoustic septum is a vibratory membrane and the acoustic backing is an anti-vibration back plate, and the acoustic unit is acoustic impedance matched, whereby the acoustic unit is configured to substantially non-propagatively absorb frontal acoustic excitation at the peak absorption frequency using the acoustic septum and the acoustic backing.

These and other aspects will be described in additional detail below.

BRIEF DESCRIPTION OF THE DRAWINGS

The various features, advantages and other uses of the present embodiments will become more apparent by referring to the following detailed description and drawing in which:

FIG. 3A is a table portraying the acoustic units having uniform constructions with the exception of varying cross-sectional dimensions, and varying peak absorption frequencies throughout an absorption frequency bandwidth based on the varying cross-sectional dimensions;

DETAILED DESCRIPTION

This disclosure teaches an acoustic panel that is broadly employable in various applications and with various items that generate acoustic excitation. The acoustic panel includes an absorption-oriented cellular acoustic unit layer that features acoustic units. The acoustic units include acoustically septumized cells and acoustic backings attached across the cells behind the acoustic septa. The acoustic units have uniform constructions with the exception of varying cross-sectional dimensions, and varying peak absorption frequencies based on the varying cross-sectional dimensions. Using the acoustic septa and the acoustic backings, the acoustic units are configured to substantially non-propagatively absorb frontal acoustic excitation at the peak absorption frequencies.

Figure 1B:
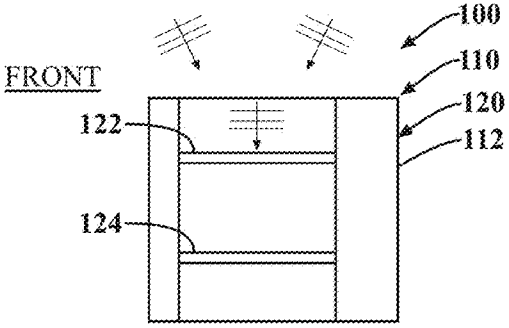
FIG. 1B is a cross-sectional view of the acoustic unit layer taken along the line 1B-1B in FIG. 1A, showing additional aspects of the acoustic units, with the acoustic units including acoustic septa attached across the cells, and acoustic backings attached across the cells behind the acoustic septa.
Figure 1A:
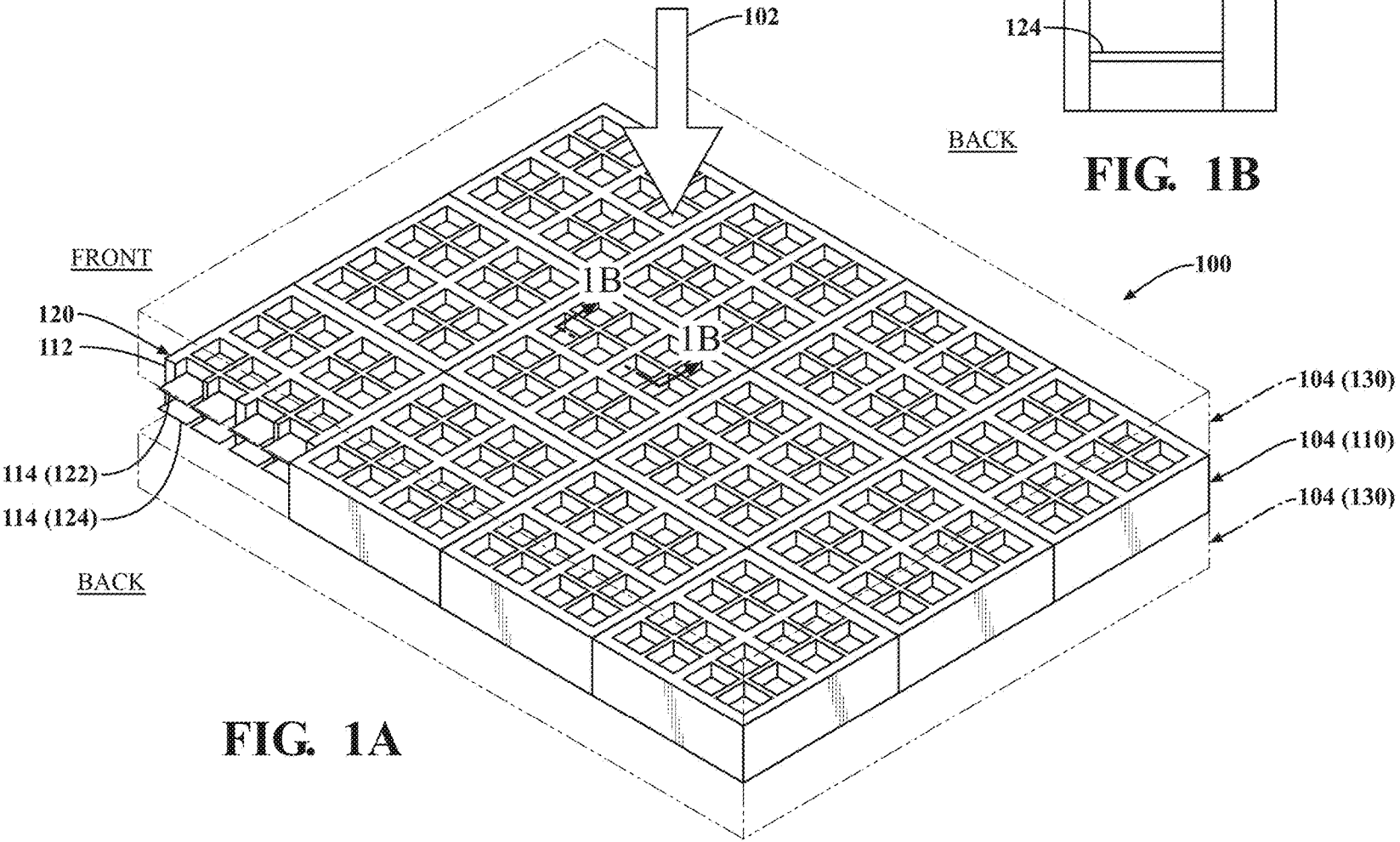
FIG. 1A is a partially broken away perspective view of an acoustic panel that includes an absorption-oriented cellular acoustic unit layer that features acoustic units, showing the acoustic units including acoustically septumized cells.

A representative acoustic panel 100 is shown in FIG. 1A. Both the structure and the configuration of the acoustic panel 100 have an interdependent relationship with the intended spatial arrangement of the acoustic panel 100 relative to physical phenomena 102, including but not limited to acoustic excitation. In this disclosure, uses of "front," "back" and the like refer to this relationship. For instance, the acoustic panel 100 is a panel-like structure that has a front and an opposing back. Moreover, the acoustic panel 100 is meant to assume frontal acoustic excitation. In other words, the acoustic panel 100 is intended for a spatial arrangement in which acoustic excitation moves toward the acoustic panel 100 and is assumed by the acoustic panel 100 at the front thereof.

The acoustic panel 100 includes one or more acoustic layers 104. As part of the construction of the acoustic panel 100, the acoustic layers 104 may be permanently interconnected as an integral unit. Similarly to the acoustic panel 100 to which they belong, each acoustic layer 104 has a front and an opposing back. Moreover, the acoustic layers 104 are meant to assume frontal acoustic excitation. In other words, the acoustic layers 104 are intended for spatial arrangements, as part of the acoustic panel 100, in which acoustic excitation moves toward the acoustic layers 104 and is assumed by the acoustic layers 104 at the fronts thereof either directly or via transfer from one or more preceding acoustic layers 104, if any.

Among the acoustic layers 104, the acoustic panel 100 includes a cellular acoustic unit layer 110. As part of the acoustic unit layer 110, the acoustic panel 100 includes normally-oriented rigid cells 112, as well as transversely-oriented acoustic elements 114 attached across (i.e., to span the inside of) the cells 112 under fixed boundary conditions therewith. Although the acoustic panel 100, as shown, includes one acoustic unit layer 110, it will be understood that this disclosure is applicable in principle to otherwise similar acoustic panels 100 including multiple acoustic unit layers 110.

Using the acoustic elements 114, the acoustic unit layer 110 is configured to attenuate the movement of frontal acoustic excitation past the acoustic unit layer 110 and, ultimately, behind the acoustic panel 100 to which it belongs. With the acoustic unit layer 110 included as part of the acoustic panel 100, the acoustic panel 100 is correspondingly configured to attenuate the movement of frontal acoustic excitation behind the acoustic panel 100. Accordingly, the acoustic panel 100 is employable in various applications and with various items that generate acoustic excitation.

For example, the acoustic panel 100 may be employed in any combination of automotive applications, marine applications, aircraft applications, construction applications, residential applications, commercial applications, industrial applications and the like. In these and other applications, the acoustic panel 100 may be employed on, in, about or otherwise with various items to attenuate the movement of frontal acoustic excitation therefrom behind the acoustic panel 100. For instance, the acoustic panel 100 may be employed as an acoustic silencer on or in items, including but not limited to as an exterior cover (e.g., a beauty cover) on items such as engines, including internal combustion engines, motors, including electric motors, transmissions, differentials and the like. Alternatively, or additionally, the acoustic panel 100 may be employed as an acoustic barrier about items, including but not limited to as a highway wall about road going vehicles.

In the acoustic unit layer 110, each cell 112 is a closed cross-sectional tubular cell-like structure that, absent elements attached across the cell 112, is open-ended. The cells 112 may serve as acoustic waveguides. As part of the construction of the acoustic unit layer 110, the cells 112 may be permanently interconnected. The cells 112 are regularly arranged, and may have any combination of polygonal and non-polygonal cross-sectional shapes. In these and other configurations, the cells 112 may have any combination of uniform and varying heights, cross-sectional dimensions, cross-sectional shapes and the like. In these and other configurations, the cells 112 may be regularly arranged with or without interstitial vacancies, including but not limited to tessellated without interstitial vacancies. For instance, as shown, the acoustic panel 100 includes row-and-column-patterned rectangular cross-section, uniform height and varying cross-sectional dimension cells 112.

As a related part of the acoustic unit layer 110, the acoustic panel 100 includes normally-oriented acoustic units 120 whose construction is based on the cells 112. Specifically, each acoustic unit 120 includes a cell 112. In the acoustic panel 100, all of the cells 112 may belong to the acoustic units 120. Alternatively, some but not all of the cells 112 may belong to the acoustic units 120. Like the cells 112 on which their construction is based, the acoustic units 120 are regularly arranged, and may have any combination of polygonal and non-polygonal cross-sectional shapes. In these and other configurations, the acoustic units 120 may have any combination of uniform and varying heights, cross-sectional dimensions, cross-sectional shapes and the like. In these and other configurations, the acoustic units 120 may be regularly arranged with or without interstitial vacancies, including but not limited to tessellated without interstitial vacancies. For instance, as shown, the acoustic panel 100 includes row-and-column-patterned rectangular cross-section, uniform height and varying cross-sectional dimension acoustic units 120.

In addition to the cell 112 thereof, each acoustic unit 120 includes one or more of the acoustic elements 114. For instance, the cells 112 are acoustically septumized. Specifically, the acoustic units 120 include one or more acoustic septa 122 attached across the cells 112. Moreover, the acoustic units 120 include one or more acoustic backings 124 attached across the cells 112 behind the acoustic septa 122.

For purposes of attenuating the movement of frontal acoustic excitation past the acoustic unit layer 110, the acoustic units 120 have one or more frequency targets (e.g., frequencies, frequency ranges and the like) about which the acoustic units 120 are configured to particularly reflect, absorb or otherwise affect frontal acoustic excitation using the acoustic elements 114. In some implementations of the acoustic units 120, for one, some or all of the frequency targets, the acoustic elements 114 may serve as acoustic metamaterials (AMMs) with respect to particularly affecting frontal acoustic excitation about the frequency targets. Alternatively, or additionally, the acoustic units 120 to which the acoustic elements 114 belong may serve as AMMs with respect to particularly affecting frontal acoustic excitation about the frequency targets. Although the acoustic units 120 particularly affect frontal acoustic excitation about the frequency targets, it will be understood that this disclosure is not exclusive to the acoustic units 120 somewhat or even particularly affecting frontal acoustic excitation outside the frequency targets.

In this disclosure, in relation to the cells 112, uses of "wavelength" and the like refer to the frequency targets. For instance, for an acoustic unit 120 with a frequency target, a subwavelength cell 112 means a cell 112 whose height and cross section are significantly smaller than the wavelengths of frontal acoustic excitation about the frequency target. A subwavelength cell 112 may mean a cell 112 whose height and cross section are approximately ten or more times smaller than the wavelengths of frontal acoustic excitation about the frequency target. Alternatively, or additionally, a subwavelength cell 112 may mean a cell 112 whose height and cross section are approximately one hundred or more times smaller than the wavelengths of frontal acoustic excitation about the frequency target.

In relation to the acoustic units 120, uses of "acoustic impedance matched," "acoustic impedance matching" and the like refer to the frequency targets. Both the frontal acoustic impedances of the acoustic units 120 or, in other words, the acoustic impedances of the acoustic units 120 at the proceeding acoustic elements 114, and the acoustic impedances of frontal acoustic excitation mediums or, in other words, mediums about the fronts of the cells 112 ahead of the acoustic elements 114, are frequency-dependent. For an acoustic unit 120 with a frequency target, the acoustic unit 120 being acoustic impedance matched means that, about the frequency target, the acoustic unit 120 has a frontal acoustic impedance that matches the acoustic impedance of an intended frontal acoustic excitation medium. For acoustic units 120 with varying frequency targets, uniform acoustic impedance matching means that, about the varying frequency targets, the acoustic units 120 have frontal acoustic impedances that match the acoustic impedance of an intended common frontal acoustic excitation medium.

In relation to the acoustic elements 114, uses of "anti-vibration," "vibratory" and the like refer to the frequency targets. For instance, an anti-vibration acoustic element 114 means an acoustic element 114 that substantially does not vibrate under frontal acoustic excitation about the frequency target. Relatedly, an anti-vibration acoustic element 114 means an acoustic element 114 that perfectly, near perfectly or otherwise substantially reflects frontal acoustic excitation about the frequency target. On the other hand, a vibratory acoustic element 114 means an acoustic element 114 that substantially vibrates under frontal acoustic excitation about the frequency target with the same phase and the same amplitude as frontal acoustic excitation. Relatedly, a vibratory acoustic element 114 means an acoustic element 114 that particularly propagatively absorbs frontal acoustic excitation about the frequency target. In the case of an acoustic unit 120 that is acoustic impedance matched, a vibratory acoustic element 114 means an acoustic element 114 that, moreover, substantially does not reflect frontal acoustic excitation about the frequency target, and therefore perfectly, near perfectly or otherwise substantially propagatively absorbs frontal acoustic excitation about the frequency target.

Uses of "stiff," "resiliently flexible" and the like refer to frontal acoustic excitation about the frequency targets. For instance, a stiff acoustic element 114 means an acoustic element 114 that exhibits stiffness to frontal acoustic excitation about the frequency targets. On the other hand, a resiliently flexible acoustic element 114 means an acoustic element 114 that exhibits resilient flexibility, including but not limited to elasticity, to frontal acoustic excitation about the frequency targets.

Uses of "plate" and the like refer to stiff plate-like structures. A plate may mean a thick plate or, in other words, a relatively thicker intrinsically stiff plate-like structure. Alternatively, a plate may mean thin plate or, in other words, a relatively thinner and otherwise flexible acquired-stiffness plate-like structure whose stiffness is acquired via applied tension under a fixed boundary condition with a cell 112. On the other hand, uses of "membrane" and the like refer to resiliently flexible, including elastic, membrane-like structures.

With the acoustic units 120 included as part of the acoustic unit layer 110, the acoustic unit layer 110 is correspondingly configured to particularly affect frontal acoustic excitation about the frequency targets using the acoustic elements 114. In broadband implementations, the acoustic unit layer 110 has one or more frequency bandwidths, and the acoustic units 120 have varying frequency targets throughout the frequency bandwidths.

In addition to the acoustic unit layer 110, the acoustic panel 100 includes one or more bulk acoustic layers 130, including a proceeding bulk acoustic layer 130 and a succeeding bulk acoustic layer 130. The bulk acoustic layers 130 are made from one or more bulk materials. For instance, the bulk acoustic layers 130 may be made from one or more foams. As a complement to the configuration of the acoustic units 120 and the acoustic unit layer 110 to which they belong, the bulk acoustic layers 130 are configured to particularly reflect, absorb or otherwise affect frontal acoustic excitation outside the frequency targets. Although the acoustic panel 100, as shown, includes one proceeding bulk acoustic layer 130, it will be understood that this disclosure is applicable in principle to otherwise similar acoustic panels 100 including multiple proceeding bulk acoustic layers 130 or no proceeding bulk acoustic layers 130. Similarly, although the acoustic panel 100, as shown, includes one succeeding bulk acoustic layer 130, it will be understood that this disclosure is applicable in principle to otherwise similar acoustic panels 100 including multiple succeeding bulk acoustic layers 130 or no succeeding bulk acoustic layers 130.

Both the construction and the configuration of the acoustic units 120, including both the construction and the configuration of the acoustic elements 114, are implementation-dependent. As shown with additional reference to FIG. 1B, for example, each acoustic unit 120 for a representative absorption-oriented implementation of the acoustic unit layer 110 includes the acoustically septumized cell 112. Specifically, in addition to the cell 112, each acoustic unit 120 includes the acoustic septum 122 attached across the cell 112. The acoustic septum 122 is attached across the cell 112 at a certain depth. For instance, the acoustic septum 122 is, as shown, attached mid-depth across the cell 112. Relatedly, the cell 112 is a subwavelength cell 112 configured to rectify diffused frontal acoustic excitation into normal frontal acoustic excitation. Although each acoustic unit 120, as shown, includes one acoustic septum 122, it will be understood that this disclosure is applicable in principle to otherwise similar acoustic units 120 including multiple acoustic septa 122. Moreover, each acoustic unit 120 includes an acoustic backing 124 attached across the cell 112 behind the acoustic septum 122.

In this and other absorption-oriented implementations of the acoustic unit layer 110, the acoustic units 120 have one or more peak absorption frequencies, including varying peak absorption frequencies throughout an absorption frequency bandwidth, at which the acoustic units 120 are configured to substantially non-propagatively absorb (as opposed to reflect or propagatively absorb) frontal acoustic excitation. Moreover, the acoustic units 120 have one or more cutoff reflection frequencies, including varying cutoff reflection frequencies throughout a reflection frequency bandwidth, higher than the peak absorption frequencies, below which the acoustic units 120 are configured to substantially reflect (as opposed to absorb) frontal acoustic excitation outside the peak absorption frequencies.

Specifically, in relation to the peak absorption frequencies, the acoustic septa 122 are vibratory membranes having one or more resonance frequencies (e.g., first resonance frequencies, second resonance frequencies, etc.) lower than the peak absorption frequencies. For instance, the vibratory membranes may have first resonance frequencies lower than the peak absorption frequencies. Moreover, in relation to the cutoff reflection frequencies and the peak absorption frequencies, the acoustic backings 124 are anti-vibration back plates having one or more resonance frequencies (e.g., first resonance frequencies, second resonance frequencies, etc.) significantly higher than the cutoff reflection frequencies and the peak absorption frequencies. For instance, the anti-vibration back plates may have first resonance frequencies approximately ten or more times higher than the cutoff reflection frequencies and the peak absorption frequencies. Among other things, it follows that for one, some or all of the peak absorption frequencies, the peak absorption frequencies are between the resonance frequencies of the vibratory membranes and the resonance frequencies of the anti-vibration back plates. For instance, it follows that the peak absorption frequencies may be between the first resonance frequencies of the vibratory membranes and the first resonance frequencies of the anti-vibration back plates.

Moreover, in relation to the peak absorption frequencies, the acoustic units 120 are acoustic impedance matched. In the case of varying peak absorption frequencies throughout an absorption frequency bandwidth, the acoustic units 120 have uniform acoustic impedance matching. The acoustic units 120 may be acoustic impedance matched, including having uniform acoustic impedance matching, to fluids, including but not limited to gasses. For instance, for applications of the acoustic panel 100 in everyday environments, the acoustic units 120 may be acoustic impedance matched, including having uniform acoustic impedance matching, to air.

Accordingly, below the cutoff reflection frequencies, including in broadband reflection frequency ranges below one, some or all of the cutoff reflection frequencies and encompassing the peak absorption frequencies, the anti-vibration back plates substantially reflect propagated frontal acoustic excitation, if any, back toward the vibratory membranes. Moreover, at the peak absorption frequencies, with the acoustic units 120 being acoustic impedance matched, the vibratory membranes substantially propagatively absorb, and therefore substantially propagate, frontal acoustic excitation, the anti-vibration back plates substantially reflect propagated frontal acoustic excitation back toward the vibratory membranes, and the overall sound energy from frontal acoustic excitation and reflected propagated frontal acoustic excitation is therefore substantially converted into elastic energy gained by the vibratory membranes. As a result, the acoustic units 120 substantially non-propagatively absorb frontal acoustic excitation at the peak absorption frequencies. Moreover, outside the peak absorption frequencies but below the cutoff reflection frequencies, even though the acoustic units 120 do not substantially non-propagatively absorb frontal acoustic excitation, the acoustic units 120 nonetheless substantially reflect frontal acoustic excitation.

For one, some or all of the peak absorption frequencies, the vibratory membranes may serve as AMMs with respect to substantially propagatively absorbing frontal acoustic excitation at the peak absorption frequencies. Specifically, the vibratory membranes may have anomalous positive effective mass densities at one, some or all of the peak absorption frequencies. Moreover, for one, some or all of the cutoff reflection frequencies, and for one, some or all of the peak absorption frequencies, the anti-vibration back plates may serve as AMMs with respect to substantially reflecting propagated frontal acoustic excitation back toward the vibratory membranes at the peak absorption frequencies and otherwise below the cutoff reflection frequencies. Specifically, the anti-vibration back plates may be anti-vibration thin back plates having broadband negative effective mass densities at one, some or all of the peak absorption frequencies and otherwise below one, some or all of the cutoff reflection frequencies. Relatedly, the acoustic units 120 to which the vibratory membranes and the anti-vibration back plates belong may serve as AMMs with respect to substantially non-propagatively absorbing frontal acoustic excitation at the peak absorption frequencies and substantially reflecting frontal acoustic excitation outside the peak absorption frequencies but below the cutoff reflection frequencies.

The acoustic units 120 and the acoustic unit layer 110 to which they belong may be made from any combination of suitable materials to promote the basic objectives of attenuating the movement of frontal acoustic excitation past the acoustic unit layer 110, as well as improving manufacturability, lowering mass and the like. For instance, the acoustic septa 122, in relation to being vibratory membranes, may be made from one or more rubbers, including but not limited to one or more silicon-based rubbers, such as polydimethylsiloxane (PDMS). Moreover, the acoustic backings 124, in relation to being anti-vibration back plates, may be made from one or more metals, including but not limited to aluminum.

In relation to the cells 112 of the acoustic units 120, the construction of the acoustic unit layer 110 may be based on any combination of standalone cell-like structures and cellular panels or, in other words, panel-like structures that include individual cell-like structures that are permanently interconnected as an integral unit. In relation to the acoustic elements 114 of the acoustic units 120, the construction of the acoustic unit layer 110 may be based on any suitable combination of standalone acoustic elements embedded on, in or otherwise with the cells 112, including but not limited to standalone acoustic septa and standalone acoustic backings. Alternatively, or additionally, the construction of the acoustic unit layer 110 may be based on any suitable combination of acoustic element layers layered on, in or otherwise with the cells 112, whose coincident locations therewith form associated acoustic elements, including but not limited to acoustic septum layers and acoustic backing layers.

Figure 2A:
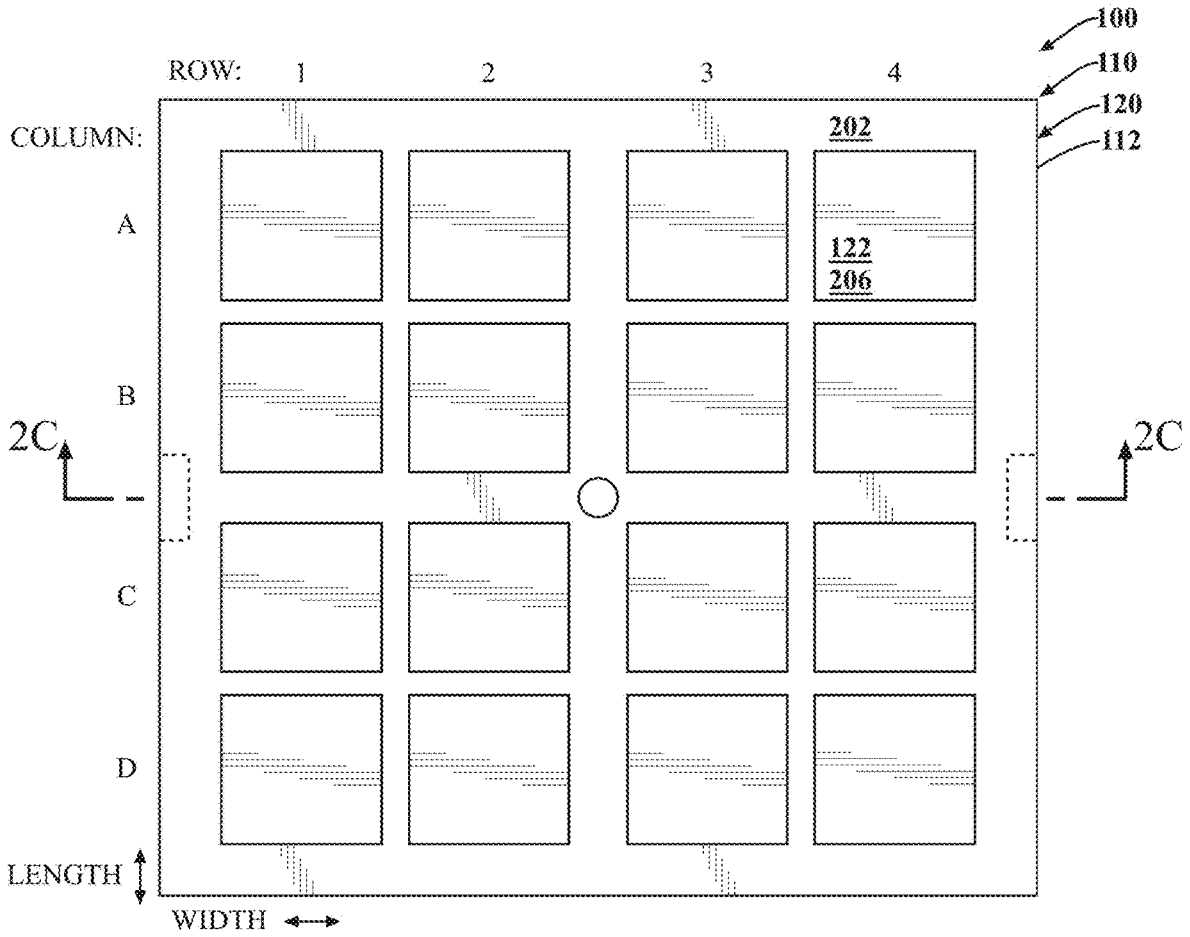
FIGS. 2A, 2B and 2C are front, side and assembly views, respectively, of the acoustic unit layer, showing a representative layered implementation thereof, in which the construction of the acoustic unit layer is based on cellular panels, an acoustic septum layer and an acoustic backing layer.
Figure 2B:
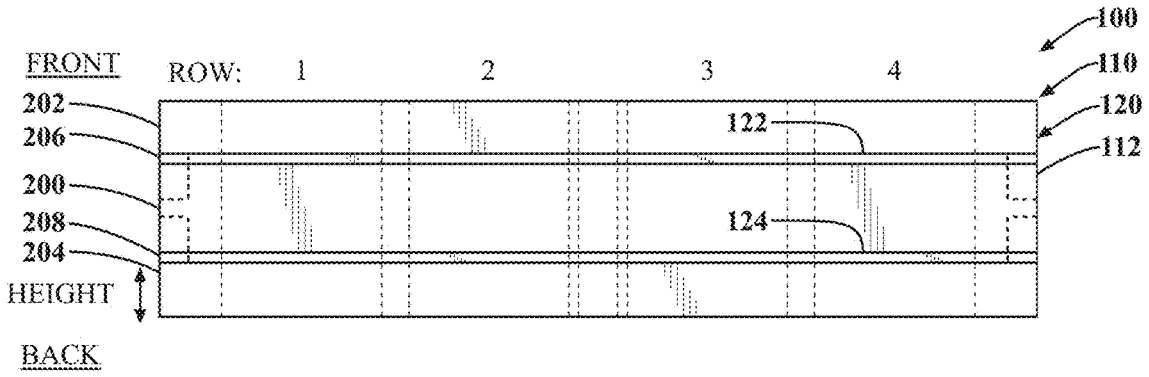
Figure 2C:
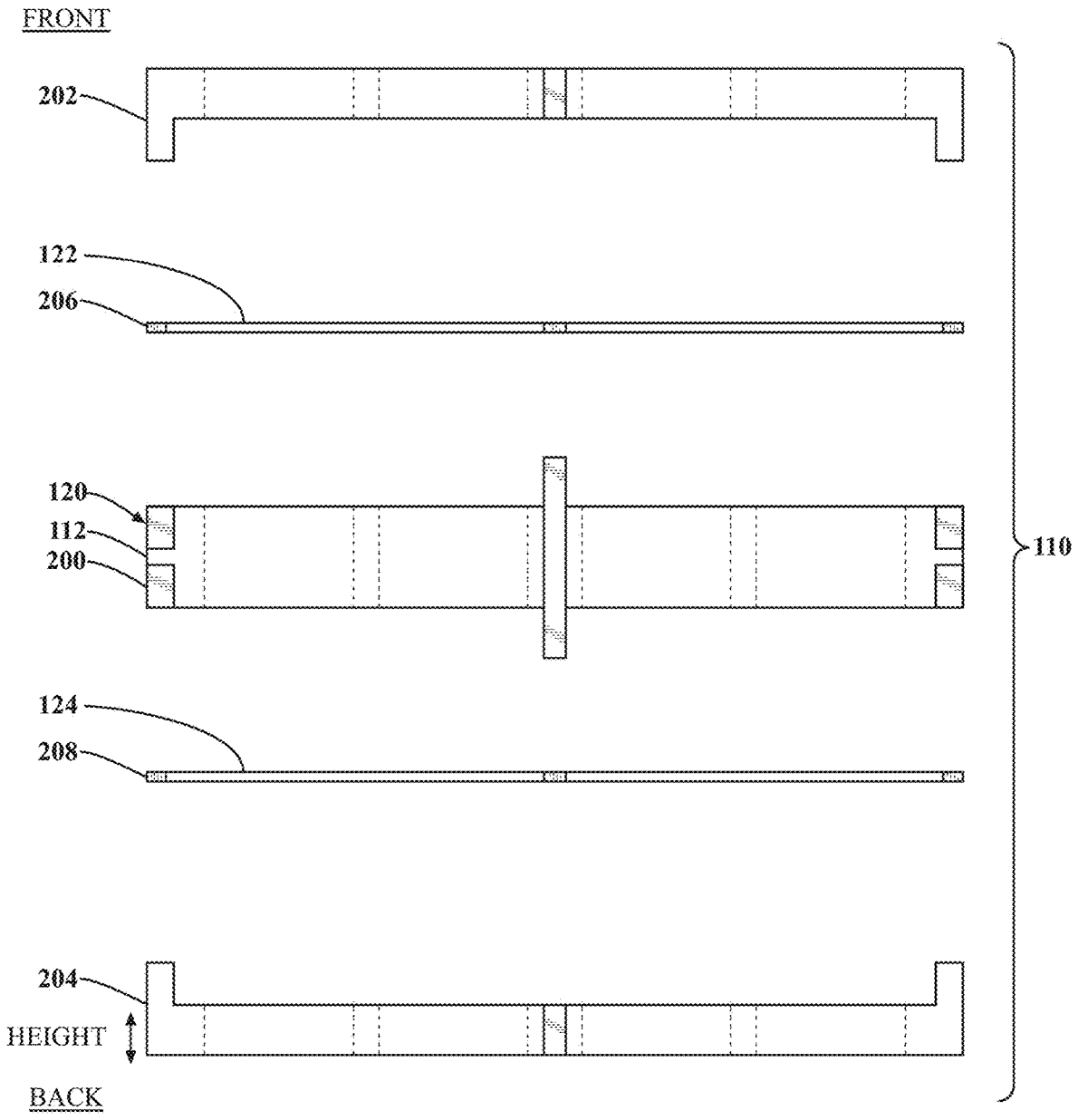

As shown with additional reference to FIGS. 2A-2C, for example, in a representative layered absorption-oriented implementation thereof, the acoustic unit layer 110 includes one or more cellular panels that form the cells 112, and one or more acoustic element layers layered with the cells 112, whose coincident locations therewith form associated acoustic elements. Specifically, the acoustic unit layer 110 includes a base cellular panel 200 that forms the bases of the cells 112. Ahead of the base cellular panel 200, the acoustic unit layer 110 also includes an aligned corresponding front cellular panel 202 that forms the fronts of the cells 112. Behind the base cellular panel 200, the acoustic unit layer 110 also includes an aligned corresponding back cellular panel 204 that forms the backs of the cells 112. Moreover, as an acoustic element layer, the acoustic unit layer 110 includes an acoustic septum layer 206 layered ahead of the base cellular panel 200, and therefore on the bases of the cells 112, whose coincident locations therewith form associated acoustic septa 122. Specifically, the acoustic unit layer 110 includes the acoustic septum layer 206 layered between the base cellular panel 200 and the front cellular panel 202, and therefore in the cells 112 at a certain depth, whose coincident locations therewith form associated acoustic septa 122 in the cells 112 at certain depths. Moreover, as an acoustic element layer, the acoustic unit layer 110 includes an acoustic backing layer 208 layered behind the base cellular panel 200, and therefore on the bases of the cells 112, whose coincident locations therewith form associated acoustic backings 124. Specifically, the acoustic unit layer 110 includes the acoustic backing layer 208 layered between the base cellular panel 200 and the back cellular panel 204, and therefore in the cells 112 at a certain depth, whose coincident locations therewith form associated acoustic backings 124 in the cells 112 at certain depths.

Figure 3B:
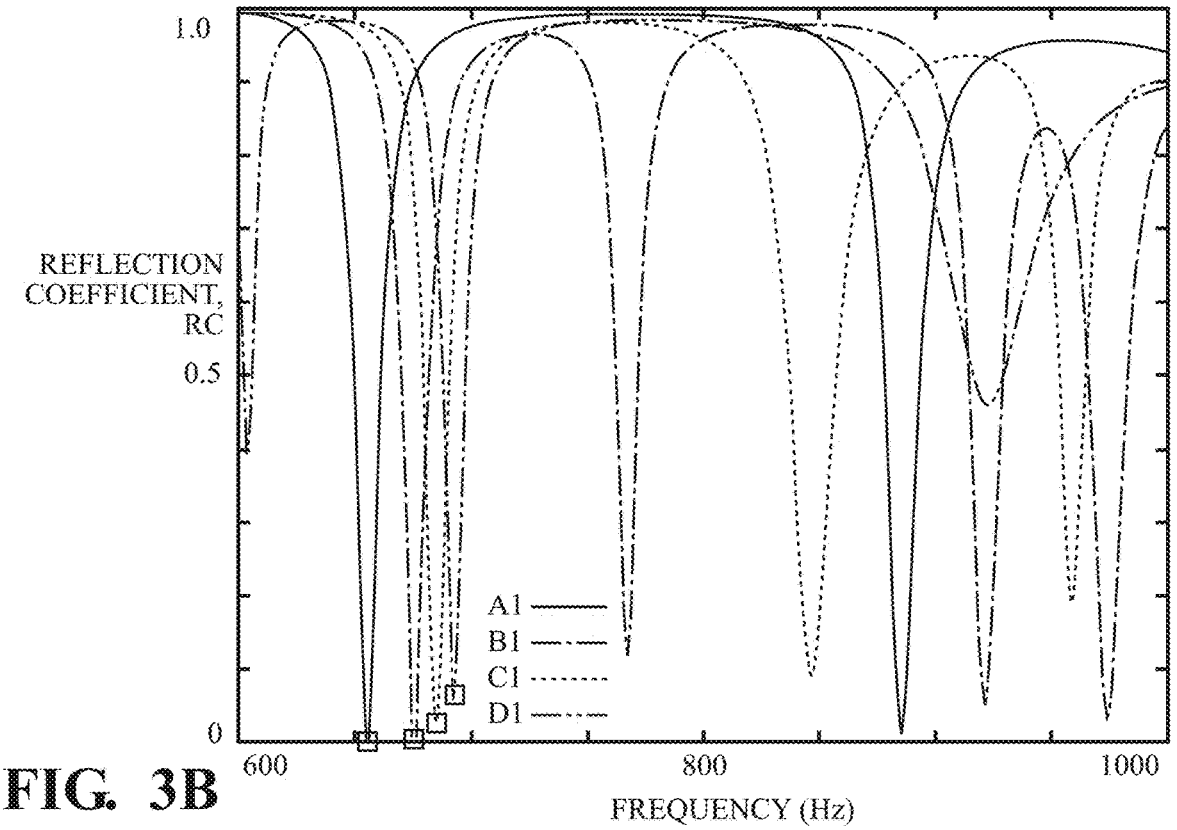
FIGS. 3B-3E are graphs portraying each acoustic unit having a reflection coefficient as a function of frequency, showing further aspects of the acoustic units having the varying peak absorption frequencies throughout the absorption frequency bandwidth based on the varying cross-sectional dimensions.
Figure 3F:
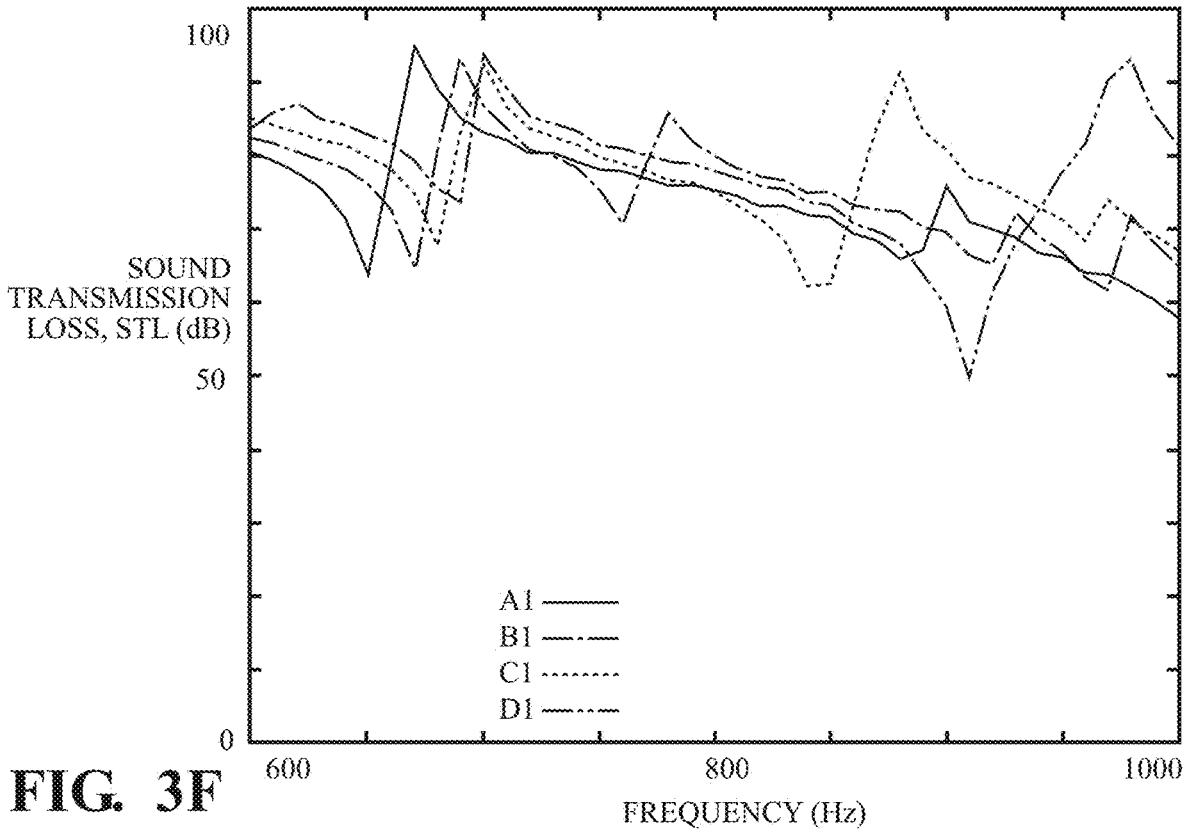
FIGS. 3F-3I are graphs portraying each acoustic unit having a sound transmission loss as a function of frequency, showing aspects of the acoustic units having cutoff reflection frequencies higher than the peak absorption frequencies.
Figure 3C:
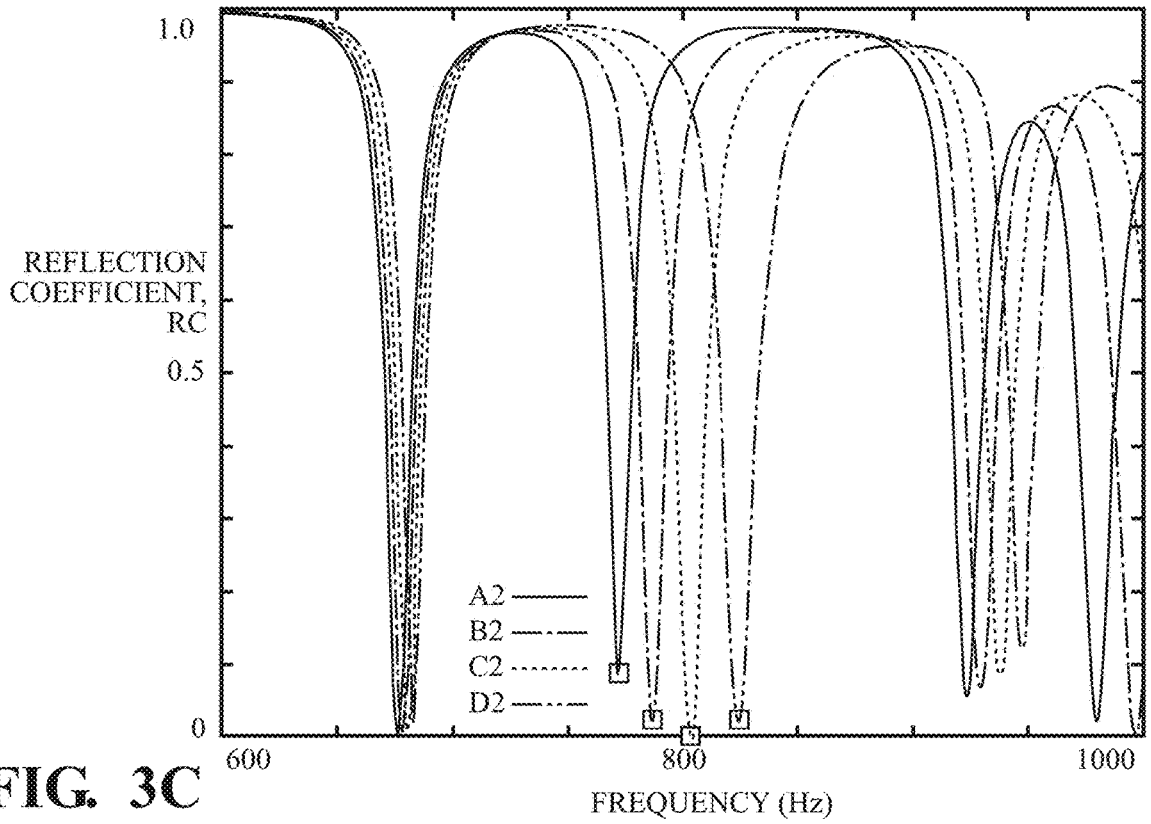
Figure 3G:
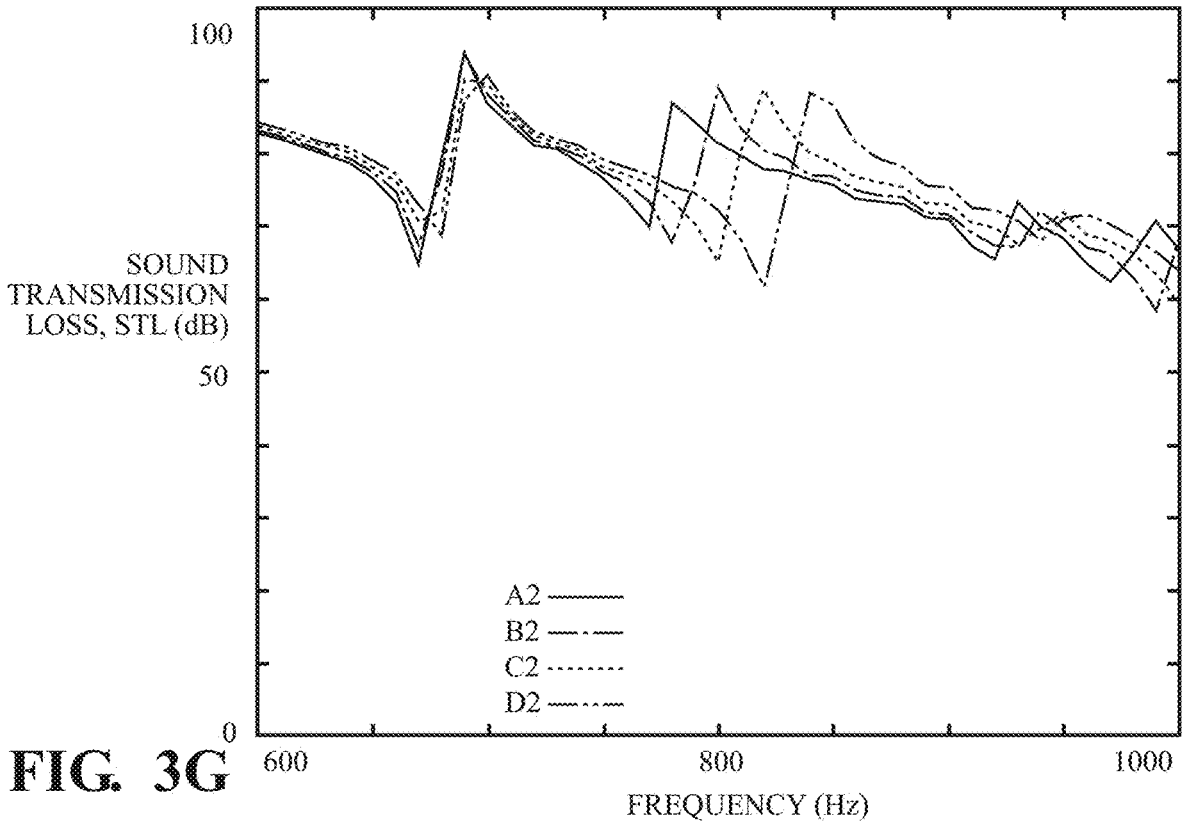
Figure 3D:
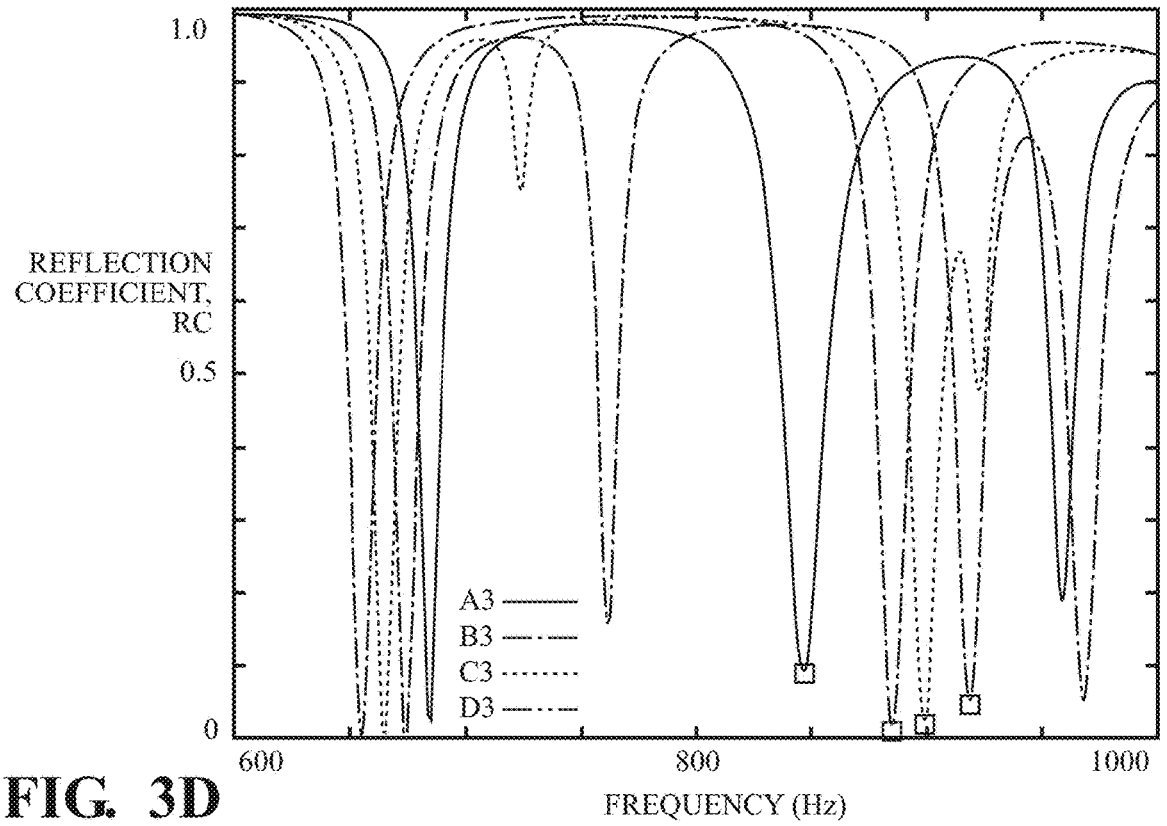
Figure 3H:
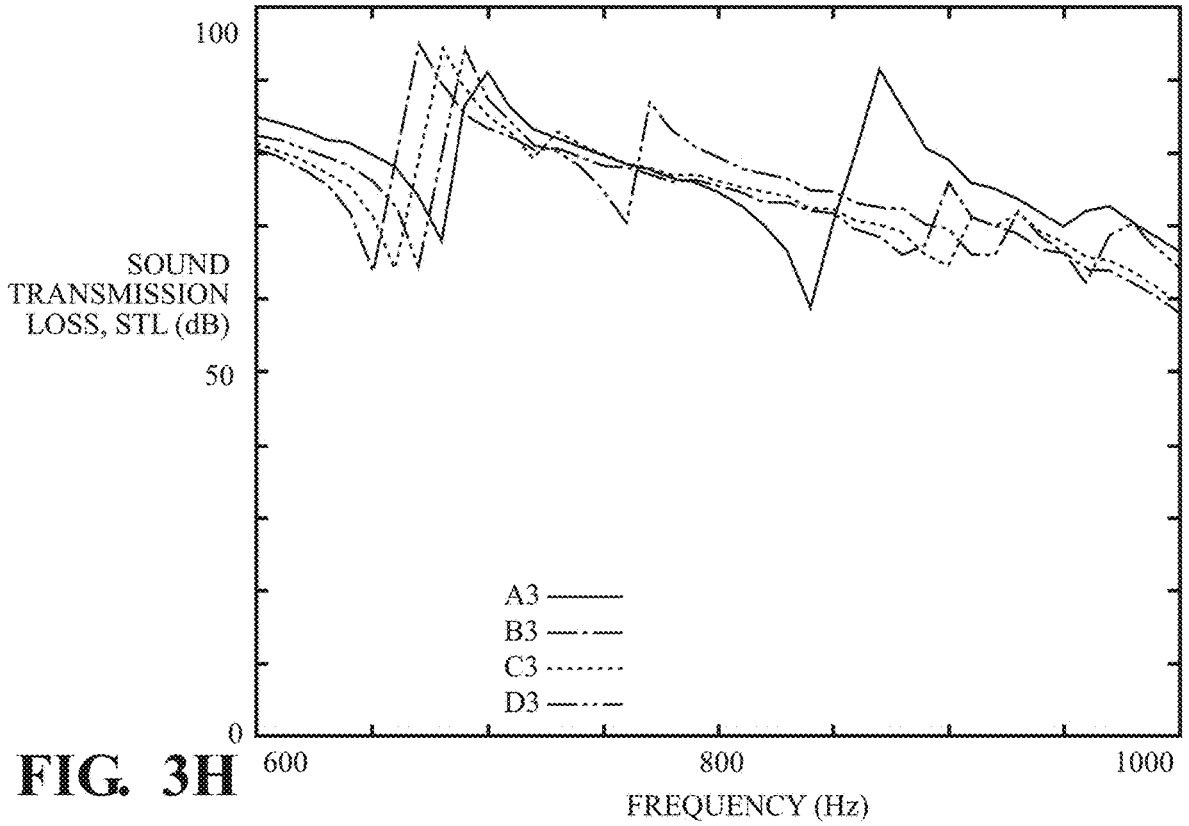
Figure 3E:
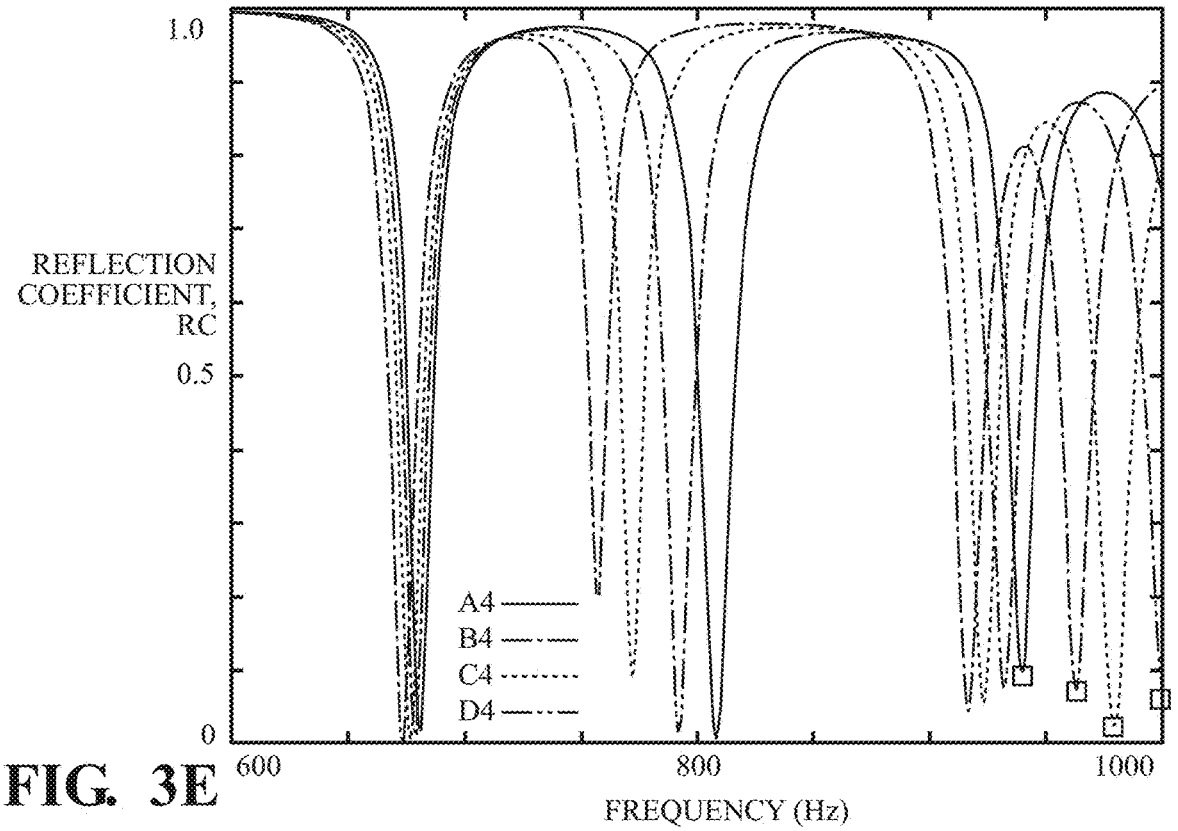
Figure 3I:
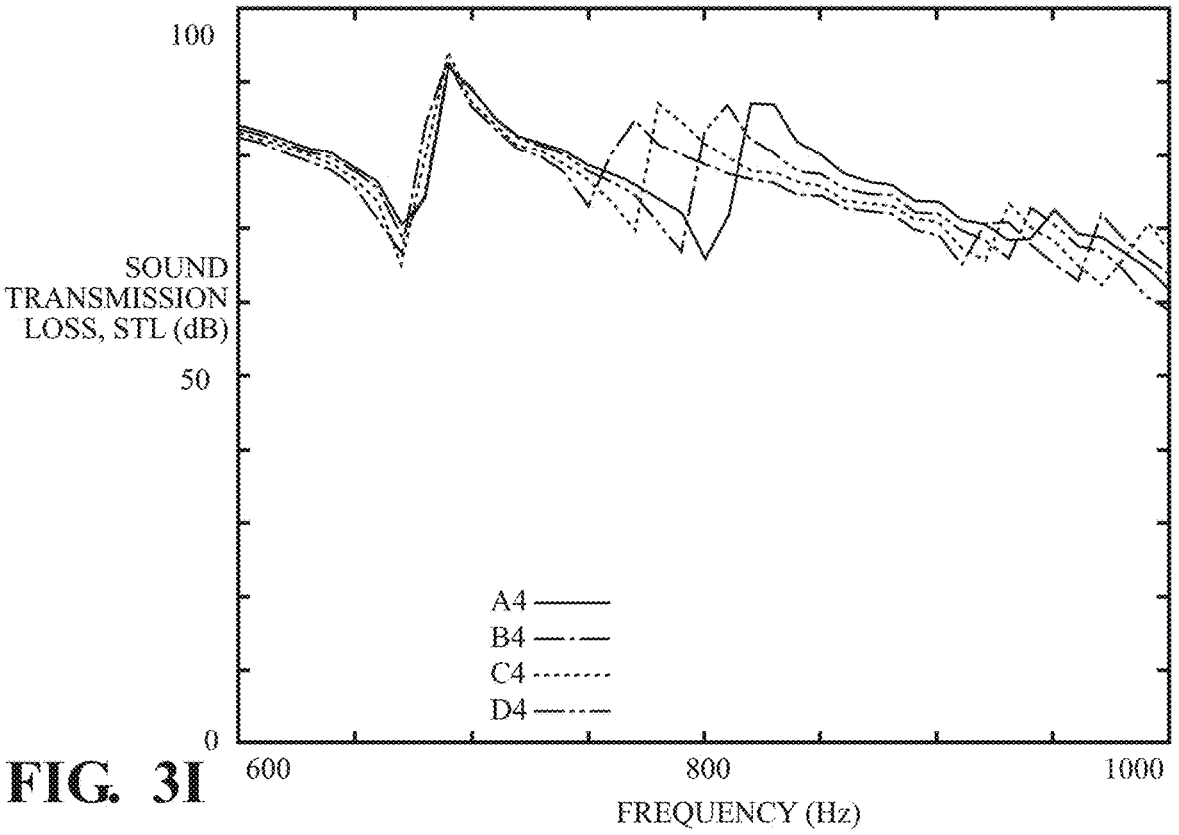

As shown with additional reference to FIG. 3A, in this and other absorption-oriented implementations of the acoustic unit layer 110, the acoustic units 120 have varying peak absorption frequencies throughout an absorption frequency bandwidth at which the acoustic units 120 substantially non-propagatively absorb frontal acoustic excitation.

For each acoustic unit 120, the peak absorption frequency, in relation to which the acoustic septum 122 is a vibratory membrane, the acoustic backing 124 is an anti-vibration back plate and the acoustic unit 120 is acoustic impedance matched, is the function of many interrelated construction variables. For instance, the peak absorption frequency is the function of the height, the cross-sectional dimensions, the cross-sectional shape and the like of the acoustic unit 120 and the cell 112 on which its construction is based. Moreover, the peak absorption frequency is the function of the height-wise position of the acoustic septum 122, including the depth of the acoustic septum 122. Moreover, the peak absorption frequency is the function of the height-wise position of the acoustic backing 124, including the depth of the acoustic backing 124. Moreover, the peak absorption frequency is the function of the thickness and the material properties of the acoustic septum 122, and the thickness and the material properties of the acoustic backing 124.

Relatedly, the varying peak absorption frequencies are based on the acoustic units 120 having varying constructions. It is contemplated that by varying the constructions of the acoustic units 120, the basic objective of the acoustic units 120 having the varying peak absorption frequencies may compete with the supplemental objectives of scalability, manufacturability and the like. Accordingly, the design of the acoustic unit layer 110 features a collaborative relationship for promoting both the basic objective and the competing supplemental objectives. Specifically, the acoustic unit layer 110 features a scalable, manufacturing-friendly design in which the acoustic units 120 have uniform constructions with the exception of varying cross-sectional dimensions, and have the varying peak absorption frequencies based on the varying cross-sectional dimensions.

For instance, as shown, the acoustic panel 100 includes the acoustic units 120 as part of one or more addable blocks that each, for a total of sixteen acoustic units 120, A1 through D4, feature four numbered rows and four lettered columns thereof. Relatedly, the acoustic panel 100 includes rectangular cross-section and varying cross-sectional dimension acoustic units 120 whose construction is based on rectangular cross-section and varying cross-sectional dimension cells 112. The acoustic units 120 and the cells 112 on which their construction is based are aligned widthwise in the columns, and aligned lengthwise in the rows.

As part of the uniform constructions, in addition to the rectangular cross-sections, the acoustic units 120 and the cells 112 on which their construction is based have uniform widths. In relation to the uniform widths, the acoustic units 120 and the cells 112 on which their construction is based are justified widthwise in the columns. Moreover, in the representative layered absorption-oriented implementation of the acoustic unit layer 110, the back cellular panel 204 has a constant height, the base cellular panel 200 has a constant height, and the front cellular panel 202 has a constant height. Moreover, the acoustic backing layer 208 is made from one piece of aluminum having a constant thickness, and the acoustic septum layer 206 is one made from one piece of PDMS having a constant thickness.

Accordingly, the acoustic units 120 and the cells 112 on which their construction is based have associated uniform heights. Moreover, the acoustic septa 122 have associated uniform height-wise positions on the bases of the cells 112, including associated uniform depths in the cells 112. Moreover, the acoustic backings 124 have associated uniform height-wise positions on the bases of the cells 112, including associated uniform depths in the cells 112. Moreover, the acoustic septa 122 have uniform thicknesses and uniform material properties, and the acoustic backings 124 have uniform thicknesses and uniform material properties.

On the other hand, as part of the varying cross-sectional dimensions, the acoustic units 120 and the cells 112 on which their construction is based have varying lengths. In relation to the varying lengths, the acoustic units 120 and the cells 112 on which their construction is based are unjustified lengthwise in the rows.

As shown, for example, in a representative absorption-oriented implementation of the acoustic unit layer 110, as part of the uniform constructions, in addition to the rectangular cross-sections, the acoustic units 120 and the cells 112 on which their construction is based have uniform widths of 19.95 mm. Moreover, the back cellular panel 204 has a constant height of 5 mm, the base cellular panel 200 has a constant height of 9.7 mm, and the front cellular panel 202 has a constant height of 5 mm. Moreover, the acoustic backing layer 208 is made from one piece of aluminum having a constant thickness of 0.4 mm, and the acoustic septum layer 206 is one made from one piece of PDMS having a constant thickness of 0.254 mm.

Accordingly, the acoustic units 120 and the cells 112 on which their construction is based have associated uniform heights of 20.354 mm. Moreover, the acoustic septa 122 have associated uniform height-wise positions of 9.7 mm on the bases of the cells 112, including associated uniform depths of 5 mm in the cells 112. Moreover, the acoustic backings 124 have associated uniform height-wise positions of 0 mm on the bases of the cells 112, including associated uniform depths of 14.954 mm in the cells 112. Moreover, the acoustic septa 122 have uniform thicknesses of 0.254 mm, and the acoustic backings 124 have uniform thicknesses of 0.4 mm. Moreover, the acoustic septa 122 have uniform material properties, including uniform Young's moduli of 4.51e^6*(1+0.01i) Pascal, uniform densities of 965 kg/m^3, and uniform Poisson's ratios of 0.48. Moreover, the acoustic backings 124 have uniform material properties, including uniform Young's moduli of 70e^9*(1+0.01i) Pascal, uniform densities of 2700 kg/m^3, and uniform Poisson's ratios of 0.3.

On the other hand, as part of the varying cross-sectional dimensions, the acoustic units 120 and the cells 112 on which their construction is based have lengths varying between 16.65 mm and 19.95 mm.

Relatedly, as shown with additional reference to FIGS. 3B-3E, as part of the absorption frequency bandwidth, the results of computer simulated testing show that the acoustic units 120 have varying peak absorption frequencies distributed between 600 Hz and 1000 Hz based on the varying lengths. In relation to the peak absorption frequency for each acoustic unit 120, the acoustic unit 120 is acoustic impedance matched to air. Moreover, at the peak absorption frequency for each acoustic unit 120, as part of substantially non-propagatively absorbing frontal acoustic excitation, the acoustic unit 120 has a near-zero reflection coefficient.

In this and other absorption-oriented implementations of the acoustic unit layer 110, the acoustic units 120 have cutoff reflection frequencies higher than the peak absorption frequencies below which the acoustic units 120 substantially reflect frontal acoustic excitation outside the peak absorption frequencies. As shown with additional reference to FIGS. 3F-3I, in relation to the absorption frequency bandwidth, the results of computer simulated testing show that the acoustic units 120 have cutoff reflection frequencies higher than 1000 Hz. Below the cutoff reflection frequency for each acoustic unit 120, including in a broadband reflection frequency range between 600 Hz and 1000 Hz and encompassing the peak absorption frequency, as part of substantially non-propagatively absorbing frontal acoustic excitation at the peak absorption frequency and substantially reflecting frontal acoustic excitation outside the peak absorption frequency but below the cutoff reflection frequency, the acoustic unit 120 has a near-perfect sound transmission loss.

Among other things, the results of computer simulated testing shown in FIGS. 3B-3I are based on not only selected materials, but also estimated frontal acoustic excitation conditions, estimated frontal acoustic excitation medium conditions, including the estimated acoustic impedance of air, estimated material properties and the like. Accordingly, it is contemplated that one, some or all of the construction variables on which the results of computer simulated testing are based may require suitable adjustment to achieve the same results in real world testing.

In this and other absorption-oriented implementations of the acoustic unit layer 110, it is contemplated that the acoustic unit layer 110 features a scalable, manufacturing-friendly design for including the acoustic units 120 having the varying cross-sectional dimensions, and the varying peak absorption frequencies based thereon. For instance, the varying cross-sectional dimensions are easily accommodated by adjusting the cellular sizing of the back cellular panel 204, the base cellular panel 200 and the front cellular panel 202. Moreover, more acoustic units 120, less acoustic units 120, acoustic units 120 having otherwise varying peak absorption frequencies based on otherwise varying cross-sectional dimensions and the like are easily accommodated by adjusting any combination of the cellular numbering and the cellular sizing of the back cellular panel 204, the base cellular panel 200 and the front cellular panel 202, as well as the sizing of the acoustic backing layer 208 and the sizing of the acoustic septum layer 206.

While recited characteristics and conditions of the invention have been described in connection with certain embodiments, it is to be understood that the invention is not to be limited to the disclosed embodiments but, on the contrary, is intended to cover various modifications and equivalent arrangements included within the spirit and scope of the appended claims, which scope is to be accorded the broadest interpretation so as to encompass all such modifications and equivalent structures as is permitted under the law.

What is claimed is:

1. An acoustic panel, comprising:

a plurality of acoustic units, each acoustic unit including a subwavelength cell, an acoustic septum attached across the cell and an acoustic backing attached across the cell behind the acoustic septum; wherein the acoustic units have uniform constructions with the exception of varying cross-sectional dimensions, and varying peak absorption frequencies based on the varying cross-sectional dimensions; and in relation to the peak absorption frequency for each acoustic unit, the acoustic septum is a vibratory membrane and the acoustic backing is an anti-vibration back plate, and the acoustic unit is acoustic impedance matched, whereby the acoustic unit is configured to substantially non-propagatively absorb frontal acoustic excitation at the peak absorption frequency using the acoustic septum and the acoustic backing.

2. The acoustic panel of claim 1, wherein as part of the uniform constructions, the acoustic units have uniform cross-sectional shapes.

3. The acoustic panel of claim 1, wherein as part of the uniform constructions, the acoustic units have rectangular cross-sections, uniform heights and uniform widths, and as part of the varying cross-sectional dimensions, the acoustic units have varying lengths.

4. The acoustic panel of claim 1, wherein as part of the uniform constructions, the acoustic units have uniform height-wise position acoustic septa and uniform height-wise position acoustic backings.

5. The acoustic panel of claim 1, wherein for each acoustic unit, the acoustic septum is attached across the cell at a depth, the cell is configured to rectify diffused frontal acoustic excitation into normal frontal acoustic excitation, and as part of the uniform constructions, the acoustic units have uniform depth acoustic septa and uniform height-wise position acoustic backings.

6. The acoustic panel of claim 1, wherein as part of the uniform constructions, the acoustic units have uniform thickness acoustic septa and uniform thickness acoustic backings.

7. The acoustic panel of claim 1, wherein as part of the uniform constructions, the acoustic units have uniform material property acoustic septa and uniform material property acoustic backings.

8. The acoustic panel of claim 1, wherein the acoustic units have varying peak absorption frequencies distributed between 600 Hz and 1000 Hz based on the varying cross-sectional dimensions.

9. The acoustic panel of claim 1, wherein in relation to the peak absorption frequency for each acoustic unit, the acoustic unit is acoustic impedance matched to air.

10. The acoustic panel of claim 1, wherein the acoustic units have varying peak absorption frequencies distributed between 600 Hz and 1000 Hz based on the varying cross-sectional dimensions, and in relation to the peak absorption frequency for each acoustic unit, the acoustic unit is acoustic impedance matched to air.

11. An acoustic panel, comprising:

a plurality of acoustic units whose construction is based on a cellular panel that at least partially forms a plurality of subwavelength, uniform height and varying cross-sectional dimension cells, an acoustic septum layer layered ahead of the cellular panel, whose coincident locations with the cells form associated uniform height-wise position acoustic septa attached across the cells, and an acoustic backing layer layered behind the cellular panel, whose coincident locations with the cells form associated uniform height-wise position acoustic backings attached across the cells behind the acoustic septa, the acoustic units respectively including the cells, the acoustic septa and the acoustic backings; wherein the acoustic units have varying peak absorption frequencies based on the varying cross-sectional dimension cells; and in relation to the peak absorption frequency for each acoustic unit, the acoustic septum is a vibratory membrane and the acoustic backing is an anti-vibration back plate, and the acoustic unit is acoustic impedance matched, whereby the acoustic unit is configured to substantially non-propagatively absorb frontal acoustic excitation at the peak absorption frequency using the acoustic septum and the acoustic backing.

12. The acoustic panel of claim 11, wherein the cells have rectangular cross-sections, uniform widths and varying lengths, and are aligned widthwise in a plurality of columns and aligned lengthwise and a plurality of rows.

13. The acoustic panel of claim 11, wherein the acoustic units have varying peak absorption frequencies distributed between 600 Hz and 1000 Hz based on the varying cross-sectional dimension cells.

14. The acoustic panel of claim 11, wherein in relation to the peak absorption frequency for each acoustic unit, the acoustic unit is acoustic impedance matched to air.

15. The acoustic panel of claim 11, wherein the acoustic units have varying peak absorption frequencies distributed between 600 Hz and 1000 Hz based on the varying cross-sectional dimension cells, and in relation to the peak absorption frequency for each acoustic unit, the acoustic unit is acoustic impedance matched to air.

16. An acoustic panel, comprising:

a plurality of acoustic units whose construction is based on a plurality of subwavelength, rectangular cross-section, uniform height and varying cross-sectional dimension cells configured to rectify diffused frontal acoustic excitation into normal frontal acoustic excitation, the acoustic units respectively including the cells, uniform depth, uniform thickness and uniform material property acoustic septa attached across the cells, and uniform height-wise position, uniform thickness and uniform material property acoustic backings attached across the cells behind the acoustic septa; wherein the acoustic units have varying peak absorption frequencies based on the varying cross-sectional dimension cells; and in relation to the peak absorption frequency for each acoustic unit, the acoustic septum is a vibratory membrane and the acoustic backing is an anti-vibration back plate, and the acoustic unit is acoustic impedance matched, whereby the acoustic unit is configured to substantially non-propagatively absorb frontal acoustic excitation at the peak absorption frequency using the acoustic septum and the acoustic backing.

17. The acoustic panel of claim 16, wherein the cells have uniform widths and varying lengths.

18. The acoustic panel of claim 16, wherein the acoustic units have varying peak absorption frequencies distributed between 600 Hz and 1000 Hz based on the varying cross-sectional dimension cells.

19. The acoustic panel of claim 16, wherein in relation to the peak absorption frequency for each acoustic unit, the acoustic unit is acoustic impedance matched to air.

20. The acoustic panel of claim 16, wherein the acoustic units have varying peak absorption frequencies distributed between 600 Hz and 1000 Hz based on the varying cross-sectional dimension cells, and in relation to the peak absorption frequency for each acoustic unit, the acoustic unit is acoustic impedance matched to air.

* * * * *